United States Patent [19]

Naud et al.

[11] Patent Number: 4,727,747

[45] Date of Patent: Mar. 1, 1988

[54] PROCESS AND INSTALLATION FOR PROTECTING A SOLID METAL AGAINST OXIDATION DURING ROLLING

[75] Inventors: Jean-Michel Naud, Mont-Saint-Martin; Gilles Vernet, Paris; Albert-Gilbert Goursat, Voisins-le-Bretonneux; Bruno Wagner, Metz, all of France

[73] Assignee: L'Air Liquide, Paris, France

[21] Appl. No.: 3,794

[22] Filed: Jan. 15, 1987

Related U.S. Application Data

[63] Continuation of Ser. No. 741,696, Jun. 6, 1985, abandoned.

[30] Foreign Application Priority Data

Jun. 7, 1984 [FR] France ..... 84 08903

[51] Int. Cl.[4] ..... B21B 9/00

[52] U.S. Cl. ..... 72/38

[58] Field of Search ..... 29/81 B, 81 C, 81 K; 72/38, 39, 40, 201, 202; 239/597

[56] References Cited

U.S. PATENT DOCUMENTS

| | | | |
|---|---|---|---|
| 2,163,699 | 6/1939 | Paul | 72/40 |
| 2,742,691 | 4/1956 | Belitz et al. | 72/38 X |
| 3,257,835 | 6/1966 | Cofer et al. | 72/38 X |
| 3,360,202 | 12/1967 | Taylor et al. | 239/597 X |
| 3,897,230 | 7/1975 | Taylor et al. | 72/201 X |

FOREIGN PATENT DOCUMENTS

| | | | |
|---|---|---|---|
| 0084902 | 1/1983 | European Pat. Off. . | |
| 3208738 | 3/1982 | Fed. Rep. of Germany . | |
| 53-43661 | 4/1978 | Japan | 72/38 |
| 53-131258 | 11/1978 | Japan | 72/38 |
| 56-119615 | 9/1981 | Japan | 72/38 |
| 59-19018 | 1/1984 | Japan | 72/38 |

OTHER PUBLICATIONS

Japanese Patent Abstract, vol. 7, No. 173(M-232) [1818].

*Primary Examiner*—E. Michael Combs
*Attorney, Agent, or Firm*—Lee C. Robinson, Jr.

[57] ABSTRACT

A process and an installation for protecting a solid metal against oxidation during a rolling operation. This installation comprises inert atmosphere enclosures supplied with an inert gas and enclosing the waiting table, in the case where the rolling is carried out by means of a strip train, or located on each side of pressure rolls around blanks to be rolled, when the rolling is carried out by means of a planetary rolling mill.

11 Claims, 8 Drawing Figures

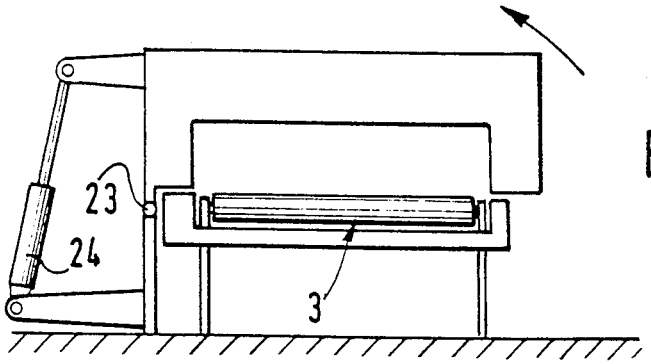
FIG.5
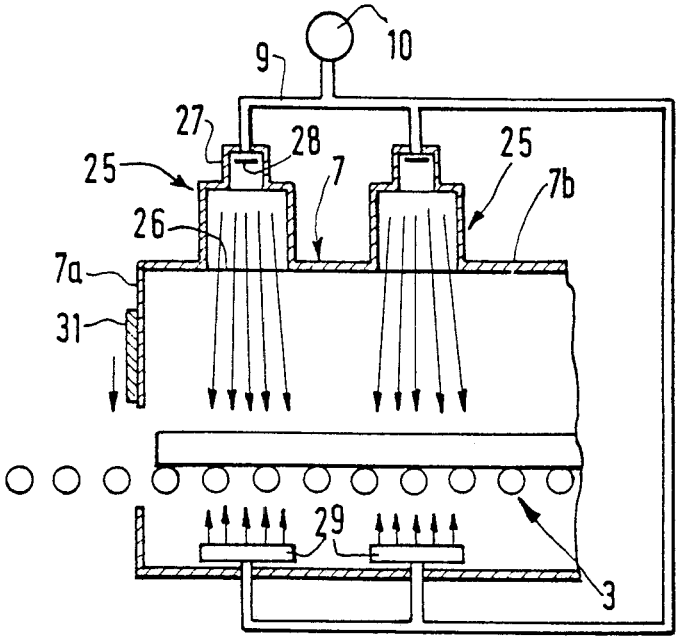
FIG.6
FIG.7
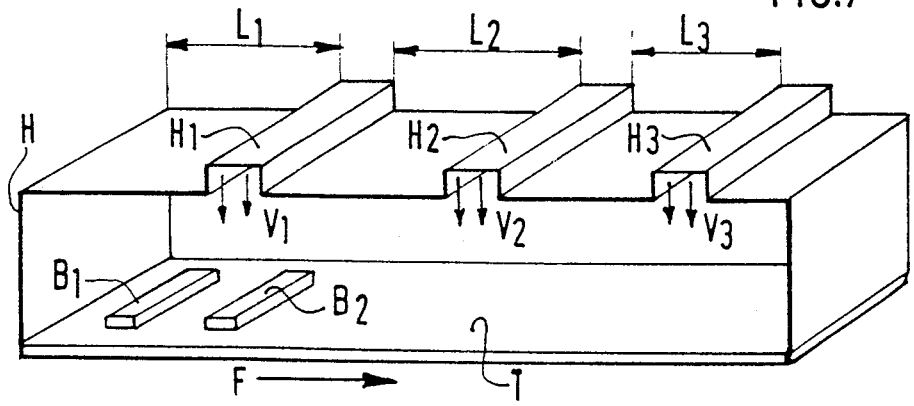

PROCESS AND INSTALLATION FOR PROTECTING A SOLID METAL AGAINST OXIDATION DURING ROLLING

This application is a continuation of application Ser. No. 741,696, filed June 6, 1985 abandoned.

BACKGROUND OF THE INVENTION

The present invention relates to a process and an installation for protecting a solid metal against oxidation during a rolling operation.

Some metallurgical processes carried out on heated solid metals and in contact with oxygen of the air result in the formation of layers of oxide which adversely affect the quality of the surface of the finished product. This problem is well known in the case of heat treatment in which are employed controlled reducing atmospheres formed by a carrier gas, such as nitrogen, argon or a mixture of these gases with hydrogen to which may be added an active gas (hydrocarbon). These atmospheres permit the control of the surface condition of the metal or the modification of the surface composition of the metal, for example by carburizing it, but in any case they avoid the oxidation.

In the case of heat treatments, the problem of the oxidation of solid metals subjected to these treatments is solved owing to the confinement of the atmosphere, due to the furnace. However, this confinement does not exist in the case of other metallurgical processes such as rolling.

In the particular case of rolling, the problems of oxidation and the descaling they require in the rolling line are very great. Indeed, the following operations appear in succession in such a rolling line:

a. Between the furnace and the roughing train, the descaling is carried out mechanically and is based on the difference of plasticity between the surface oxide formed and the metal.
b. In the course of the roughing, the descaling is carried out by means of interposed descaling cages operating with water under high pressure, on the order of 100 to 150 bars.
c. On the downstream side of the roughing stand, a new hydraulic descaling is carried out before the finishing stand, so as to eliminate the scale formed on the waiting table.
d. Finally, a pickling with acid is effected following the cooler so as to eliminate surface defects.

These multiple operations result in a number of drawbacks. For example, there is a loss of metal by oxidation, and additional consumption of power takes place owing to the descaling with water under pressure. Furthemore, there is a substantial drop in temperature of the metal owing to the descalling with water, and it is necessary to dispose of the iron sulphates and chlorides resulting from the acid pickling.

Confronted with such a situation, there is at present observed a probable evolution of the rolling operation. For example, in the case of hot rolling, there is envisaged the use of the planetary rolling mill which permits great reductions in thickness in a single pass. This technique requires a very low speed of introduction of the metal into the planetary rolling mill so as to avoid reaching excessively high speeds at the output end. However, this favours a re-oxidation of the metal before it enters the planetary rolling mill. Moreover, a mechanical descaling by shot-blasting is not used since it would give rise to problems of working conditions, placement of the equipment and encrusting in the metal.

SUMMARY

An object of the present invention is to overcome these drawbacks by providing a process for protecting the metal against oxidation during a rolling operation by the use of very simple means.

For this purpose, the invention provides a process for protecting a solid metal against oxidation during a rolling operation effected by a strip rolling train or a planetary rolling mill, wherein the blank to be rolled is passed, upstream of one rolling stand or stands, through an enclosure into which an inert gas is permanently injected.

In the case where the rolling is effected by means of a strip train, the whole of the waiting table on the upstream side of the finishing stand is rendered inert.

In the case where the rolling is effected by means of a planetary rolling mill, the inert atmosphere producing operation is carried out in enclosures located respectively on the upstream side and downstream side of the pressure rolls on the upstream side of the working rolls.

Another object of the invention is to provide an installation for carrying out the process of the invention. The installation comprises inert atmosphere enclosures supplied with inert gas and enclosing the waiting table in the case where the rolling is carried out by means of a strip train, or located on each side of the pressure rolls, around the blanks to be rolled, when the rolling is carried out by means of a planetary rolling mill.

Various embodiments of the invention will now be described, by way of non-limiting examples, with reference to the accompanying drawings in which:

BRIEF DESCRIPTION OF THE DRAWINGS

FIG. 5 is a diagrammatic vertical end view as seen from the line V—V of FIG. 4;

FIG. 6 is a partial diagrammatic vertical longitudinal sectional view of a modification of an inert atmosphere enclosure; and FIG. 7 is a diagrammatic perspective view of another modification of an inert atmosphere enclosure.

DESCRIPTION OF CERTAIN PREFERRED EMBODIMENTS

Figure 1:
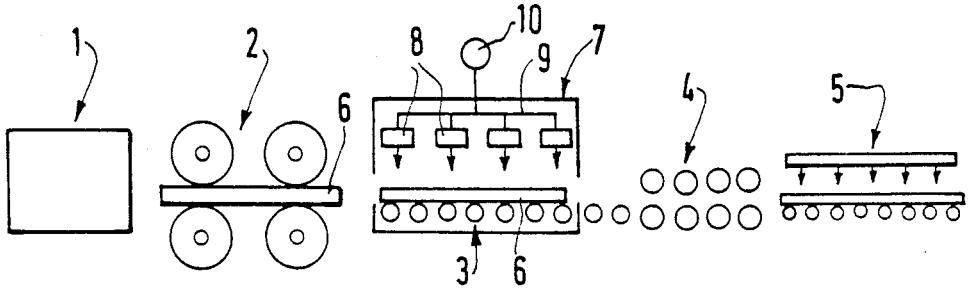
FIG. 1 is a diagrammatic side view of a rolling installation employing the process according to the invention, in the case of a strip rolling train.

FIG. 1 shows a slat rolling installation comprising in succession a furnace 1, a roughing stand 2, a waiting table 3, a finishing stand 4 and a cooler 5 through which pass slabs 6 to be rolled.

According to the invention, the whole of the waiting table 3 is enclosed in an inert atmosphere enclosure 7 which comprises, above the table 3 proper, a plurality of inert gas distributing chambers 8. The chambers 8 are located in the upper part of the inert atmosphere enclosure 7 and direct toward the slabs 6 on the waiting table 3, currents of an inert gas whose flow may be regulated individually or together. Distribution chambers 8 are connected together through pipes 9 to a source 10, of an inert gas, which may be nitrogen.

The process according to the invention thus limits the formation of scale on the slabs 6 on the waiting table 3 before they pass into the finishing train 4.

Figure 2:
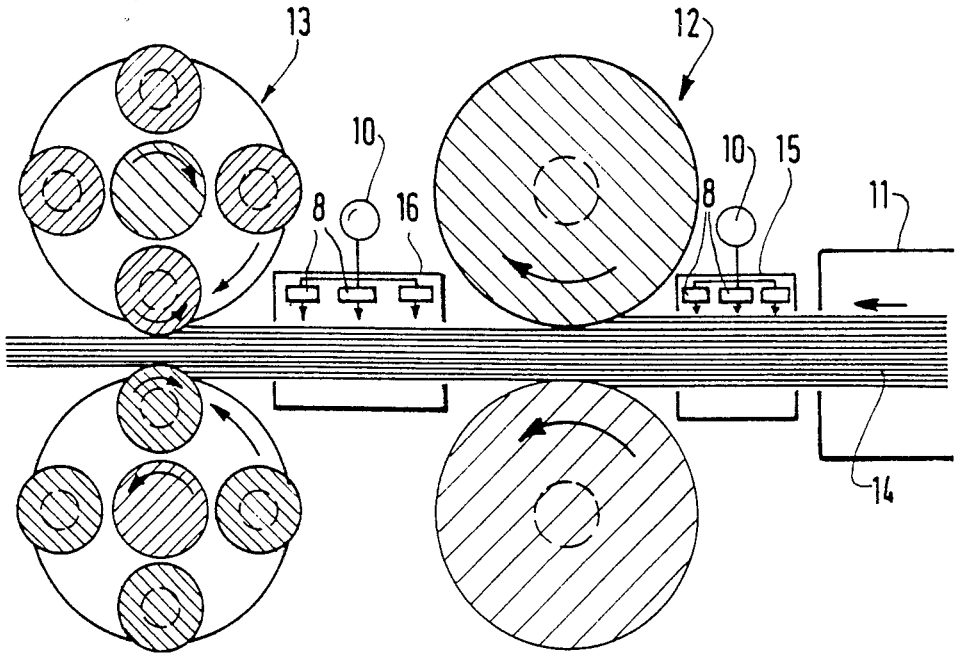
FIG. 2 is a diagrammatic vertical longitudinal sectional view of a planetary rolling installation.

In the embodiment illustrated in FIG. 2, the process according to the invention is applied to rendering inert slabs rolled by means of a planetary rolling mill. This mill comprises, at the output end of a mechanical descaling device 11, an assembly of pressure rolls 12 which is followed by an assembly of working rolls 13. In order to protect the slab 14 being rolled, there are also provided inert atmosphere enclosures 15 and 16 similar, in their principle of operation, to the inert atmosphere enclosure 7. The enclosure 15 is disposed between the descaling device 11 and the pressure rolls 12 while the other inert atmosphere enclosure 16 is disposed between the pressure rolls 12 and the assembly of working rolls 13. Here again each of the inert atmosphere enclosures 15 and 16 has a plurality of distribution chambers 8 disposed above the slab and directing currents of inert gas coming from corresponding sources 10.

In a surprising manner, it was found that the application of the process of the invention in the case of a planetary train such as shown in FIG. 2 not only reduced the roughness of the surface of the rolled product before the final pickling stage but also distinctly reduced the roughness after pickling. The process provided a surface roughness close to that obtained for the same products produced on the strip train (without rendering them inert).

The following table shows the comparative results obtained.

| | | without inert gas | | with inert gas | | | | reference strip |
|---|---|---|---|---|---|---|---|---|
| N° TEST | | 1 | 2 | 3 | 4 | 5 | 6 | train |
| μm | RT | 23 | 11 | 9 | 8 | 8 | 12 | 8 |
| before | RP | 10 | 4 | 4 | 3 | 3 | 6 | 5 |
| descaling | RA | 1.5 | 0.7 | 0.8 | 0.7 | 0.8 | 0.6 | 1 |
| μm | RT | 24 | 31 | 21 | 16 | 19 | 14 | 11 |
| after | RP | 12.5 | 15 | 10 | 7 | 7.5 | 5 | 6 |
| descaling | RA | 3.7 | 4.2 | 2.2 | 1.8 | 2.1 | 1.3 | 1 |

In this table,
RT = total roughness (microns)
RP = mean depth
RA = mean difference with R.P.

Figure 3A:
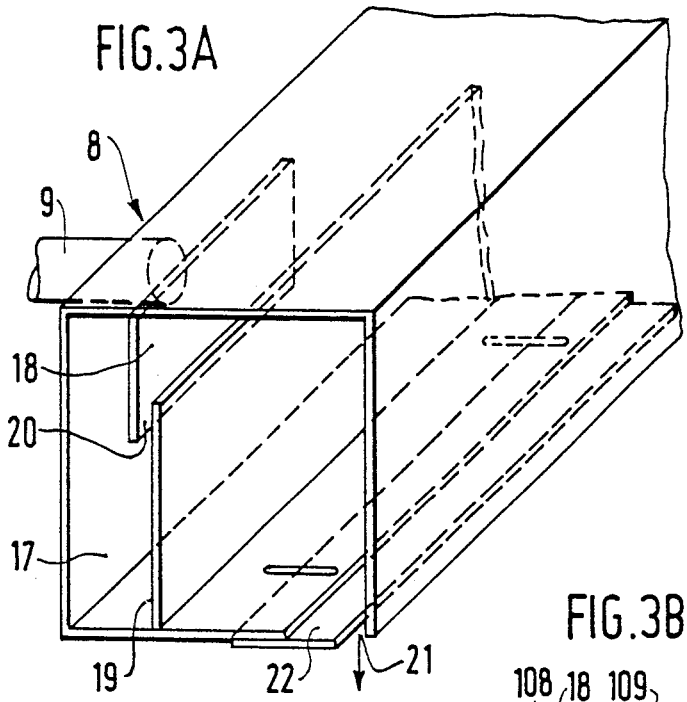
FIG. 3A is a partial perspective view of a distribution chamber for the inert gas.
Figure 3B:
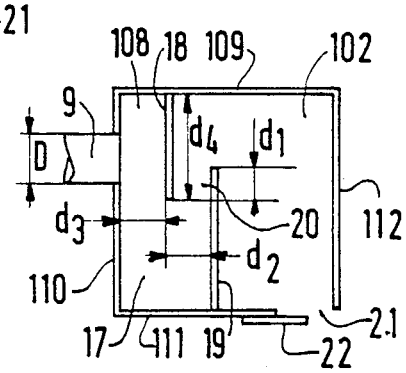
FIG. 3B is a schematic end view of the distribution chamber of FIG. 3A.

FIGS. 3A and 3B are diagrammatic views of an embodiment of a distribution chamber 8 according to the invention. This chamber is a parallelelepiped connected through a pipe 9 to a source of an inert gas and extending in a parallel direction transversely above the steel slabs. The pipe 9 leads to an expansion chamber 108 defined by a vertical partition wall 18 connected to the upper side 109 of the chamber 8. This partition wall is placed in front of the pressurized inert gas inlet and enables the expansion of the incoming gas so that the pressure P1 in the chamber 108 is lower than atmospheric pressure. The width of this partition wall (its dimension parallel to the slot 21) will preferably be less than 5 times the diameter D of the pipe 9, the latter opening out in a plane of vertical symmetry of the chamber 8 which is perpendicular to the slot 21 so as to ensure a symmetrical distribution of the inert gas in said chamber. The distance $d_3$ between the partition wall 18 and the discharge end of the pipe 9 is such that the pressure variation within the expansion chamber 108 is less than or equal to 0.4 bar. The lower edge of the partition wall 18 defines, with the walls 110 and 111 and the partition wall 19, the inert gas distribution chamber in which the pressure of the gas is homogenized. This partition wall 19 is connected to the side 111 of the chamber 8 throughout its length. The partition walls 18 and 19, owing to their relative position and dimensions (the partition wall 19 terminates in a horizontal edge at a distance $d_1$ above the lower edge of the partition wall 18), define a first baffle for the passage of the inert gas.

Preferably, the area of a section in a vertical plane of the expansion chamber (namely $d_3 \times d_4$) will be substantially equal to the area of a vertical section of the first baffle (namely $d_2 \times d_1$) so as to avoid any gas accelerating phenomenon.

The walls 109, 112 and the partition wall 19 define a gas distribution chamber 102 creating a second baffle in the bath of this gas which must be discharged through the slot 21. The slot 21 has an adjustable width and is located on the lower side 111 of the chamber 8, this slot extending throughout the length of the chamber 8 in a direction parallel to the edges of the latter. The pressure $P_2$ prevailing in the chamber 102 is such that the pressure difference $(P_1 - P_2)$ produces an ejection velocity on the gas through the slot 21 lower than 0.5 m/s. The more or less large width of this slot enables the rate of discharge to be varied for a constant gas input velocity. For this purpose, the flap 22 which controls the opening of the slot may advantageously cooperate with the circuit measuring the oxygen in the vicinity of the slab mentioned hereinfter. It is for examiple sufficient to sample the measured value of the concentration of oxygen at given intervals of time and, when the difference between the measured value and the set or desired value exceeds a predetermined value, to advance the flaps of the various distribution chambers in one direction or the other through a predetermined distance. In this way, the flow is automatically controlled as a function of the oxygen present.

The regulation of the flow of the inert gas, for example nitrogen, may be effected automatically as a function of the partial pressure of oxygen in the vicinity of the slab. For this purpose, the concentration of oxygen in the vicinity of the slab is measured with a sensor whose signal is compared with a desired set value. When the measured value is higher than the set value, this causes the flow of the inert gas to increase from the corresponding chamber until the value measured by the sensor becomes once more lower than the set value. This regulation may be effected for all of the distribution chambers 8 of the same inert atmosphere enclosure (by means of a single sensor) or individually for each of these chambers 8. The individual control system permits a comparison of the value measured by each oxygen sensor with a set value which is different for each chamber. For example, more oxygen may be tolerated at the ends of the waiting table than in the central part thereof.

Figure 4:
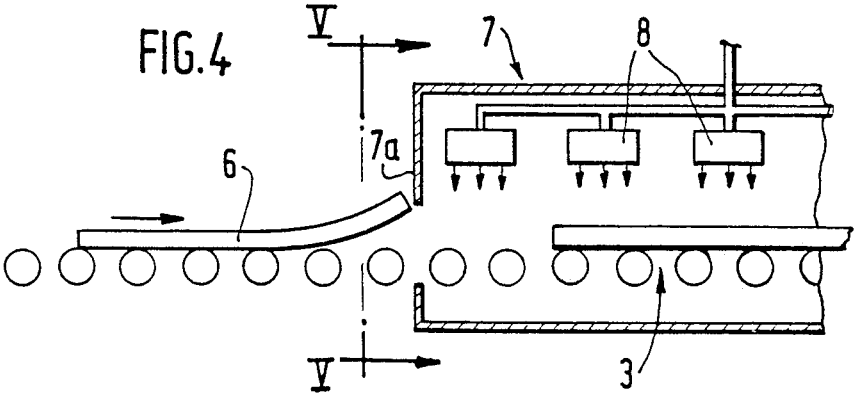
FIG. 4 is a diagrammatic vertical longitudinal sectional view of the upstream part of an inert atmosphere enclosure enclosing a waiting table of a strip rolling train.

With reference now to FIGS. 4 and 5, there is shown a modification of the installation for taking into account the fact that, in certain cases, the leading proportions of the slabs 6 arrive from the furnace with an upwardly curved shape. These slabs 6 could encounter the front transverse wall 7a at the upstream end of each inert atmosphere enclosure 7. To overcome this drawback, in an embodiment of the invention, the upper part of the inert atmosphere enclosure 7 is mounted to be pivotable about a horizontal and longitudinal axis 23 extending along one side of the waiting table 3, and this upper part of the enclosure 7 is coupled to an elevating device, such as a jack 24. Consequently, if a slab strikes against the front wall *7a*, owing to its curvature, it is sufficient to raise by means of the jack 24 the upper part of the inert atmosphere enclosure 7 by pivoting it about the longitudinal axis 23 to allow the slab to pass.

For eliminating the foregoing drawback, other means may be provided, for example by raising the whole of the upper part of the inert atmosphere enclosure 7 in vertical movement of translation.

In the embodiment illustrated in FIG. 6, the inert atmosphere enclosure 7 comprises a plurality of distribution chambers 25. The chambers 25 are in the form of cylindrical boxes open in their lower part and connected to the horizontal upper wall *7b* of the inert atmosphere enclosure 7. The portions of the wall *7b* beneath the distribution chambers 25 are provided with orifices 26 for the inlet of the inert gas. Each of the distribution chambers 25 is surmounted by an expansion chamber 27 which is also cylindrical but smaller in diameter and is connected through the pipe 9 to the source 10 of inert gas. Mounted in this expansion chamber 27 is a horizontal screen 28 forming a baffle. The distribution chambers or boxes 25 are disposed, in the upstream part of the inert atmosphere enclosure 7, in such manner as to ensure a flow and an appropriate distribution of the currents of inert gas introduced into the inert atmosphere enclosure. These high-flow currents highly dilute the quantity of oxygen which is then drawn off in the inert atmosphere enclosure 7 when a slab enters the latter.

As can be seen in FIG. 6, the inert atmosphere enclosure 7 may also include, below the waiting table 3, perforated booms or systems 29. The system 29 diffuse the inert gas by directing currents of this gas upwardly toward the rollers of the waiting table 3 so as to dilute the oxygen in this region. The oxygen is carried along by the rollers of the waiting table 3.

The front upstream wall *7a* of the inert atmosphere enclosure 7 of course has an opening of sufficient size to permit the passage of the slab 6. This opening may be permanently closed, to prevent the entry of the outside oxygen, by a curtain of inert gas directed across the opening. The opening may also be closed by a vertically-sliding sealed door 31 which may be lowered to close the opening when a slab 6 is not introduced into the enclosure 7.

FIG. 7 represents an embodiment of the process of the invention which performs particularly well.

The slabs $B_1$, $B_2$... wait on the conveyor belt T in the enclosure H which is filled with inert gas. The latter is injected through the chambers $H_1$, $H_2$ and $H_3$ having respectively a gas injecting velocity $V_1$, $V_2$ and $V_3$ and disposed in succession respectively at distances apart $L_1$, $L_2$ and $L_3$. The direction of the feed of the slabs is indicated by the arrow F. Under these conditions, it was surprisingly found that less scale was obtained on the slabs (oxidation) by progressively increasing the velocity of injection of the gases from the chambers $H_1$, $H_2$ and $H_3$ and not by establishing a higher velocity (and consequently a higher rate of flow) at the inlet of the enclosure H, namely in the chamber $H_1$, as was thought previously. The velocity of injection must of course remain lower than 0.5 m/sec.

By way of example, and for a chamber H 20 meters long, in which slabs are waiting at a temperature on the order of 1150° C., there were placed three chambers spaced apart at distances $L_1=3$ meters, $L_2=6$ meters, and $L_3=6$ meters respectively. The velocity $V_1$, $V_2$ and $V_3$ were 0.16 m/sec., 0.33 m/sec. and 0.5 m/sec respectively. Slabs were obtained in this way having the qualities of roughness mentioned in the foregoing table in the section "μm" before descaling with inert gas (test 3, 4, 5 and 6).

We claim:

1. An installation for protecting a solid metal blank against oxidation during a rolling operation, the installation comprising, in combination:

a rolling stand disposed along the path of travel of the blank to be rolled;

means for advancing said blank along said path through said rolling stand;

an enclosure located along said path upstream of the rolling stand, said blank being advanced along said path through said enclosure;

a plurality of inert gas distributing chambers located within said enclosure in position to direct inert gas toward said blank at a plurality of spaced points along the path of travel of said blank, said gas distributing chambers providing successive reductions in pressure of the inert gas prior to the time it reaches said blank and producing an ejection velocity of the gas below about 0.5 m/sec; and means for injecting inert gas into the gas distributing chambers within said enclosure.

2. An installation as defined in claim 1 which further comprises, in combination:

means for individually regulating the flow of inert gas from each of the gas distributing chambers.

3. An installation as defined in claim 1 in which each of the gas distributing chambers comprises an expansion chamber positioned within said distributing chamber and communicating with the inert gas injecting means, said expansion chamber defining a slot extending in a transverse direction with respect to the path of travel of said blank and communicating with the remaining portion of the distributing chamber.

4. An installation as defined in claim 1 in which each of the gas distributing chambers is in the form of a parallelepiped casing.

5. An installation as defined in claim 1 in which each of the gas distributing chambers is of cylindrical configuration.

6. An installation as defined in claim 1 in which each of the gas distributing chambers defines an opening for the entry of said blank as it moves along its path of travel; and means for directing inert gas across said opening to form a curtain of inert gas.

7. An installation for protecting solid metal blanks against oxidation during a rolling operation, the installation comprising, in combination:

a rolling stand disposed along the path of travel of successive blanks to be rolled;

means for advancing said blanks along said path through said rolling stand;

an enclosure located along said path upstream of the rolling stand, said blanks being advanced in succession along said path through said enclosure;

a plurality of inert gas distributing chambers located within said enclosure in position to direct inert gas toward a blank therein at a plurality of spaced points along the path of travel of said blank, each of said inert gas distributing chambers including an expansion chamber defining a first slot and an additional chamber communicating with said expansion chamber through said first slot and defining a second slot, said gas distributing chambers providing successive reductions in pressure of the inert gas prior to the time it reaches said blank and producing an ejection velocity of the gas below about 0.5 m/sec; and means for injecting inert gas into the expansion chambers in each of the gas distributing chambers within said enclosure, the injected gas flowing from each said expansion chamber through the corresponding first slot into the additional chamber and then through the corresponding second slot toward said blank.

8. An installation as defined in claim 7 in which each of said slots extends in a direction transverse to the path of travel of said blanks.

9. An installation as defined in claim 7 in which each of said additional chambers includes an adjustable plate forming one edge of the corresponding second slot.

10. A process for protecting a solid metal blank against oxidation during a rolling operation, the process comprising, in combination:

advancing the blank to be rolled in a planetary rolling mill through a rolling stand;

passing said blank through an enclosure upstream of the rolling stand;

injecting inert gas into said enclosure and toward said blank at a plurality of spaced points along the path of travel of said blank; and progressively increasing the rate of injection of the inert gas at successive injection points along said path of travel and maintaining the rate of injection of the inert gas below about 0.5 m/sec.

11. A process as defined in claim 10, in which the spaced points at which said inert gas is injected are located in the upper portion of the enclosure, and which further comprises injecting inert gas at at least one additional point in the lower portion of said enclosure.

* * * * *